US005554092A

United States Patent [19]

Harpstead et al.

[11] Patent Number: 5,554,092

[45] Date of Patent: Sep. 10, 1996

[54] APPARATUS AND METHOD FOR TESTING AND EXERCISING PELVIC MUSCLES

[75] Inventors: Stanley D. Harpstead, Arden Hills; Hugh Hestad, Eden Prairie, both of Minn.

[73] Assignee: Dacomed Corporation, Minneapolis, Minn.

[21] Appl. No.: 253,710

[22] Filed: Jun. 3, 1994

[51] Int. Cl.[6] ..... A63B 21/065

[52] U.S. Cl. ..... 482/148; 482/105

[58] Field of Search ..... 482/93, 82, 105, 482/92, 148

[56] References Cited

U.S. PATENT DOCUMENTS

| | | | |
|---|---|---|---|
| 1,291,465 | 1/1919 | Foreman . | |
| 2,521,336 | 9/1950 | Bramson | 482/93 |
| 2,763,265 | 9/1956 | Waters . | |
| 3,838,853 | 10/1974 | Fredenhagen . | |
| 4,241,912 | 12/1980 | Mercer . | |
| 4,253,660 | 3/1981 | Tiktin . | |
| 4,278,248 | 7/1981 | Kifferstein | 482/93 |
| 4,369,967 | 1/1983 | Kimura . | |
| 4,384,714 | 5/1983 | Kimura . | |
| 4,431,185 | 2/1984 | Cisneros | 482/93 |
| 4,801,137 | 1/1989 | Douglas | 482/82 |
| 4,895,363 | 1/1990 | Plevnik et al. | 482/93 |
| 5,213,557 | 5/1993 | Firth | 482/93 |
| 5,407,412 | 4/1995 | Plevnik et al. | 482/105 |

FOREIGN PATENT DOCUMENTS

| | | |
|---|---|---|
| 10198641 | 11/1990 | European Pat. Off. . |
| 2058571 | 4/1981 | United Kingdom . |
| 2272168 | 5/1994 | United Kingdom . |

OTHER PUBLICATIONS

Give Your Training Program Some Added Weight.; Dacomed Corporation; Minneapolis, Minnesota; 1993; 1 page.

Pelvic Muscle Exercises: Physiotherapy for the Pelvic Floor; Lo Laycock, PhD, FCSP; 1994; 5 pages.

*Clinical Gynecologic Urology,* Edited by Stuart L. Stanton, 1984, pp. 35–42.

International Continence Society, Fifteenth Annual Meeting, London, United Kingdom, Sep. 3–6, 1985, pp. 267–268.

International Continence Society, Uro Dynamics Society, Third Joint Meeting, Boston, Massachusetts, Sep. 17–19, 1986, pp. 227–229.

*Physiotherapy,* Jul., 1987, vol. 73, No. 7, pp. 371–373.

*British Journal of Obstetrics and Gynecology,* Oct., 1988, vol. 95, pp. 1049–1053.

*Neurology and Urodynamics,* vol. 7, No. 3, 1988, International Continence Society, 18th Annual Meeting, Oslo, Norway, Sep. 1–3, 1988, pp. 265–268.

Professor A. Zanollo, XII Congresso Nazionale della Societ Italiana di Urodinamica, Roma, 1988, Reparto di Urologia, Unit di Urodinamica; Ospedale di Magenta, Milano, pp. 39–42.

*Primary Examiner*—Stephen R. Crow

*Attorney, Agent, or Firm*—Merchant & Gould

[57] ABSTRACT

An apparatus for testing and/or strengthening pelvic floor muscles includes an external casing having two separate pieces threaded or snap fit together, and a set of inserts having different weights being individually positioned in the external casing.

17 Claims, 7 Drawing Sheets

APPARATUS AND METHOD FOR TESTING AND EXERCISING PELVIC MUSCLES

BACKGROUND OF THE INVENTION

The present invention relates to a pelvic muscle testing and/or strengthening apparatus and method for testing and/or strengthening pelvic muscles. More particularly, the present invention relates to an adjustable weight pelvic muscle testing and/or exercising apparatus and method of using same.

Exercises for the perineal muscles, also referred to as pelvic floor muscles, are often prescribed by physicians for various reasons including strengthening the pelvic muscles which assist in the control of urinary incontinence or stress incontinence. Stress incontinence results in urine leakage during physical stress. Physical stress can occur when physically exerting oneself such as when lifting or moving heavy objects. However, such stress can also occur when coughing, sneezing, etc. Indeed, occasionally stress incontinence can result when simply standing up.

Stress incontinence is typically caused by a weakening of the pelvic muscles. This might be due to the normal aging process or child bearing. Stress incontinence can be treated by exercising the pelvic muscles. However, it is often difficult to teach proper exercising of the pelvic muscles during a brief office visit. Moreover, it is often difficult to obtain and insure patient compliance with an exercise regimen because women have difficulty in exercising the proper muscles. Oftentimes, women contract the wrong muscle group such as the abdominal muscles. In addition, there is often no specific feedback providing the person with information on how strong the pelvic muscles are or the amount of force which is being applied by the pelvic muscles.

Expensive and time consuming biofeedback devices have been developed in an effort to overcome some of these problems and provide more reliable exercising of the pelvic muscles. These devices typically include a probe which is inserted into the vagina. The vaginal probe is electrically connected to an external control device. Pressure on the probe is transduced into electrical signals and transmitted to the control device. The signals are then converted into a discernable output, e.g., visual or audio; by the control device to provide patient feedback on the changes in vaginal pressure being detected by the probe. The problem with such devices is that they relatively expensive and time consuming. Typically the patient must be at a health care facility in order to use such devices which is very inconvenient.

In order to overcome the above noted problems with the biofeedback devices, various mechanical devices have been developed which are configured for insertion into the vagina. Upon insertion, the pelvic muscles grip the device thereby exercising the pelvic muscles. Through repeated use over a period of time, the pelvic muscles are thus strengthened. Examples of such devices are disclosed in U.S. Pat. Nos. 2,763,265, 4,241,912 and 4,895,363 and UK Patent Application no. GB 2058571 A.

Pat. No. 2,763,265 discloses a device for exercising the pelvic muscles which is contoured and proportioned with multiple protuberant zones for exercising the pelvic muscles in sequence as the device is introduced into the vagina.

UK Patent Application No. G 2058571 A describes a device for exercising the perineal muscles. The device includes a shaft having a tapered portion with an enlarged spherical end for insertion in the vagina. The device includes an eyelet at the other end of the device such that various weights can be suspended from the end of the device.

U.S. Pat. No. 4,241,912 describes an isometric vaginal exercise device including a rounded shaft having a flange attached to one end thereof. The shaft has a concave portion adjacent the flange, wherein the diameter of the concave portion decreases to a minimum value and then increases to a maximum value with increasing distance from the flange along the shaft. Upon insertion into the vagina, the cave portion is gripped by the paravaginal muscles of the user. The flange has an oval shape to permit accommodation between the legs of the user. A handle is attached to the flange end of the device.

U.S. Pat. No. 4,895,363 discloses a set of devices of identical size and shape, but of different weight. One of the devices is inserted into the vagina, and if the pelvic muscles are capable of retaining that weight, the device is replaced by a heavier device of the set. The heaviest device that can be retained is a measure of a pelvic floor muscle strength, and the muscles can be exercised by retaining the device for a predetermined time, such as fifteen to twenty minutes per day.

While the aforementioned devices are cheaper and more practical than the use of typical biofeedback devices, the nevertheless have various undesired characteristics associated therewith. For example UK Patent Application GB 2058571 A rather cumbersome to use in that it requires the use of hanging weights. U.S. Pat. Nos. 2,763,265 and 4,241,912 do not allow use of varying weights. U.S. Pat. No. 4,895,363 uses a plurality of devices which are all of identical size and shape. Many users require different sizes of devices in order to provide a better fit for the exercise device. These are but some of the undesirable features associated with the prior art.

The present invention provides an improved apparatus and method for testing and/or exercising pelvic muscles which offers many advantages over existing devices.

SUMMARY OF THE INVENTION

The present invention relates to a pelvic floor muscle testing and/or strengthening device.

One embodiment of the pelvic floor muscle testing and/or strengthening device generally in accordance with the principles of the present invention includes an external casing and a plurality of inserts being respectively positioned into the external casing.

In one embodiment, the multiple external hollow casings of varying external size are provided so as to provide a better individualized fit. In one embodiment, the multiple casings all have the same sized cavity. A plurality of the inserts are provided of the same external size but varying weight. The inserts are configured and sized for placement in the cavity of the casings. Once an individual has selected an external casing which best fits them, they can vary the weight of the exercise device by choosing one of the inserts.

In one embodiment of the present invention, the device has an external "tampon like" geometric contour for easy vaginal insertion, fit and removal. The external casing is made of a bio-compatible material which can be cleaned and sterilized.

In one embodiment of the present invention, a replaceable cord for removing the device from a body cavity is fastened to the external casing. The cord is made of a soft pliable threading or plastic material.

In one embodiment, an exercise kit is provided wherein there are multiple hollow casings of varying external sizes and a plurality of inserts having different weights positionable in the hollow casing.

The present invention in one embodiment pertains to a method of testing and/or exercising pelvic muscles comprising the step of selecting an insert from a plurality of inserts of differing weights and inserting the insert in a hollow casing. The casing with the insert is then inserted into the vagina. In one embodiment, when testing the strength of the pelvic muscles, the weight of the casing/insert combination is gradually increased until the device is no longer supported in the vagina. This provides an indication of the strength of the pelvic muscles. In one embodiment, when exercising the pelvic muscles, a casing/insert combination is retained in the vagina for a period of time. This is periodically repeated so as to gradually strengthen the pelvic muscles.

These and various other advantages and features of novelty, which characterize the invention are pointed out with particularity in the claims annexed hereto and forming a part hereof. However, for a better understanding of the invention, its advantages and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views.

DETAILED DESCRIPTION OF THE PREFERRED EMBODIMENT

Figure 1:
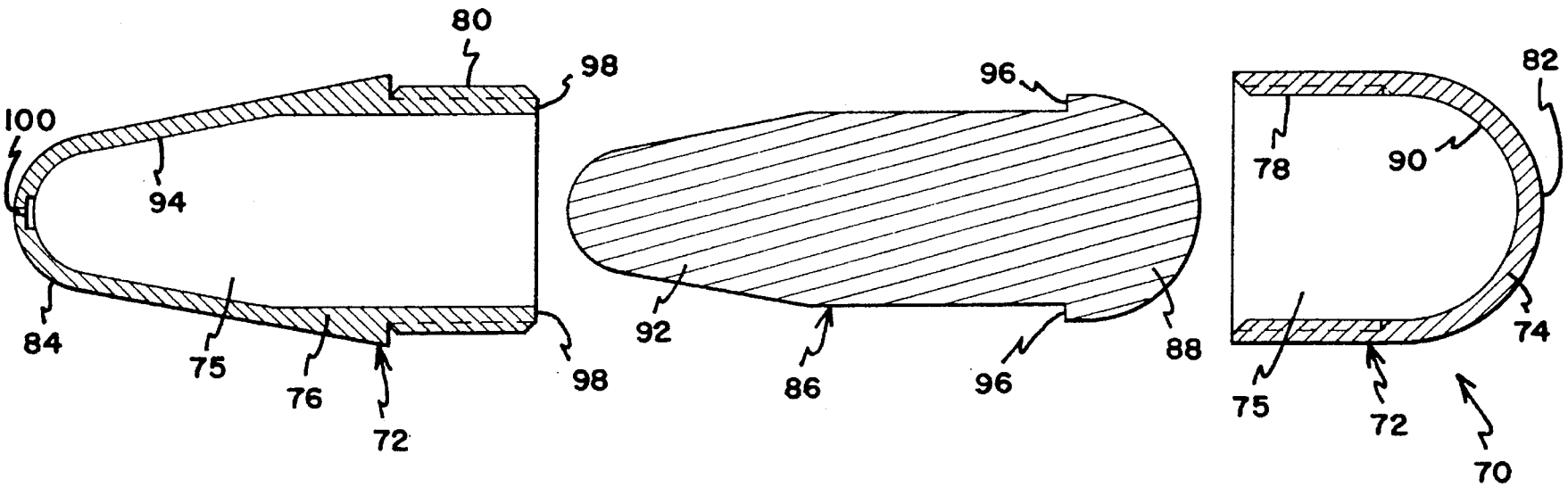
FIG. 1 is an exploded cross-sectional view of a pelvic floor muscle testing and/or strengthening device in accordance with the present invention.

In FIG. 1, there is shown an embodiment of a pelvic floor muscle testing and/or strengthening device in accordance with the principles of the invention (hereinafter called "device") which is designated the reference number 70.

The device 70 has an external two piece casing 72 including a top piece 74 and a bottom piece 76 which defines a hollow inner chamber or cavity 75. An inner threaded wall portion 78 of the top piece 74 is threadedly engaged with an outer threaded wall portion 80 of the bottom piece 76 so that the hollow inner chamber 75 is defined by the top and bottom pieces 74,76 threadedly attached to one another. The top and bottom pieces 74,76 can be repeatedly attached and detached by simply threading and unthreading them. It will be appreciated that the top and bottom pieces 74, 76 might be removably attached by other methods; e.g., they might be snap fitted together.

The casing 72 has a "tampon like" geometric contour wherein the top piece 74 has a curved end 82, and the bottom piece 76 has a narrower cone shaped end portion 84. Thus, the device 70 can be easily inserted into the vaginal cavity of the user (not shown). It will be appreciated that the casing 72 might have other configurations and yet be in keeping with the principles of the invention.

The material of the external casing 72 is a bio-inert material, such as polystyrene plastic, that is able to be easily cleaned and sanitized. The casing pieces 74 and 76 might be made in any suitable manner. For example, they might be injection molded or machined out. Preferably the casings 74 and 76 have a minimum wall thickness of 0.039 inches.

Figure 2:
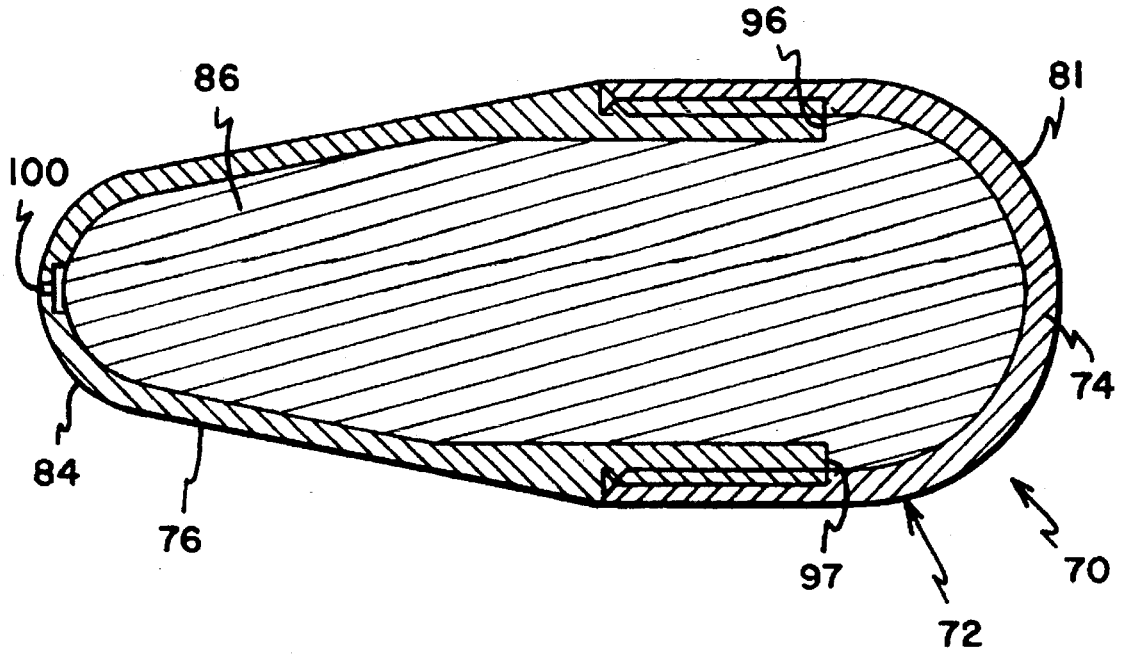
FIG. 2 is a cross-sectional view of the pelvic floor muscle testing and/or strengthening device.

An insert 86 is positionable in the hollow inner chamber 75. The insert 86 has a head portion 88 contoured to abut or be in close proximity with an inner wall 90 of the top piece 74 and a body portion 92 contoured to abut or be in close proximity with at least a portion of an inner wall 94 of the bottom piece 76. The insert 86 further includes a shoulder portion 96 between the head portion 88 and the body portion 92 which circumferentially surrounds the insert 86. As shown in FIG. 2, upon being positioned in the casing 72, the shoulder portion 96 engages an end 97 of the bottom piece 76 so as to support the insert 86 in the casing 72, the head portion 88 being disposed in a cavity in the top piece 74 of the casing 72 and the body portion 92 being disposed in a cavity in the bottom piece 76.

In the preferred embodiment of the invention a plurality of the inserts 86 having a different weight are used with the casing 72 to provide a pelvic muscle exercise and/or test device whose weight can be varied by simply selecting one of the inserts 86 and placing the insert in the casing 72. In a preferred embodiment a plurality of the casings 72 are also provided. The casings 72 preferably define a cavity of the same size and configuration but have different external sizes. Accordingly, the present invention allows the individualization of the exercise device in that an appropriate sized casing can be selected by the user.

Figure 3:
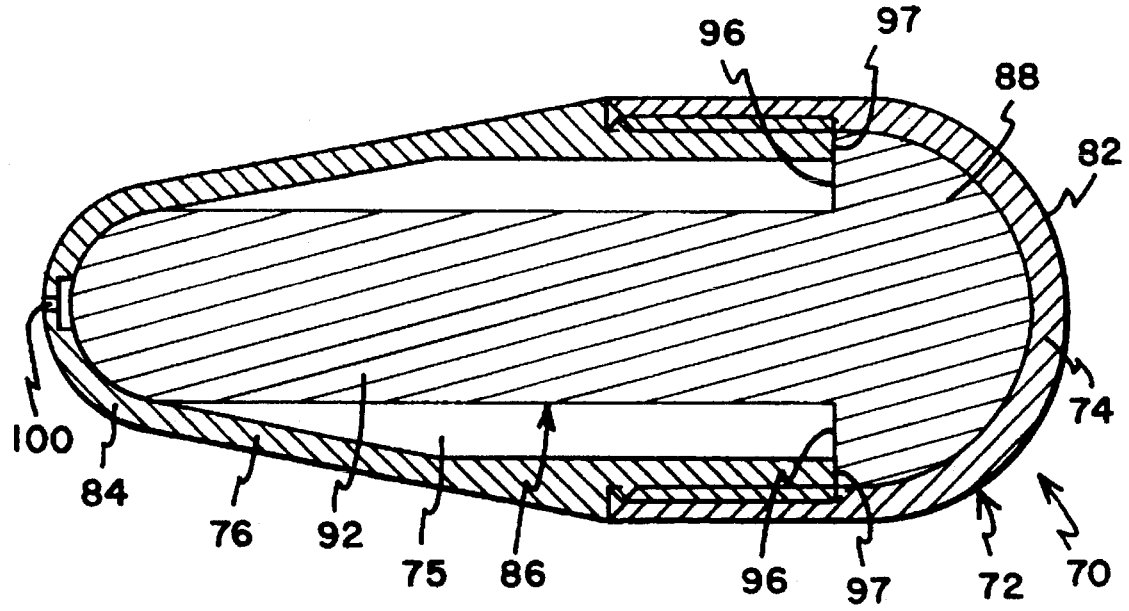
FIG. 3 is a cross-sectional view of the pelvic floor muscle testing and/or strengthening device having a narrower insert.
Figure 4:
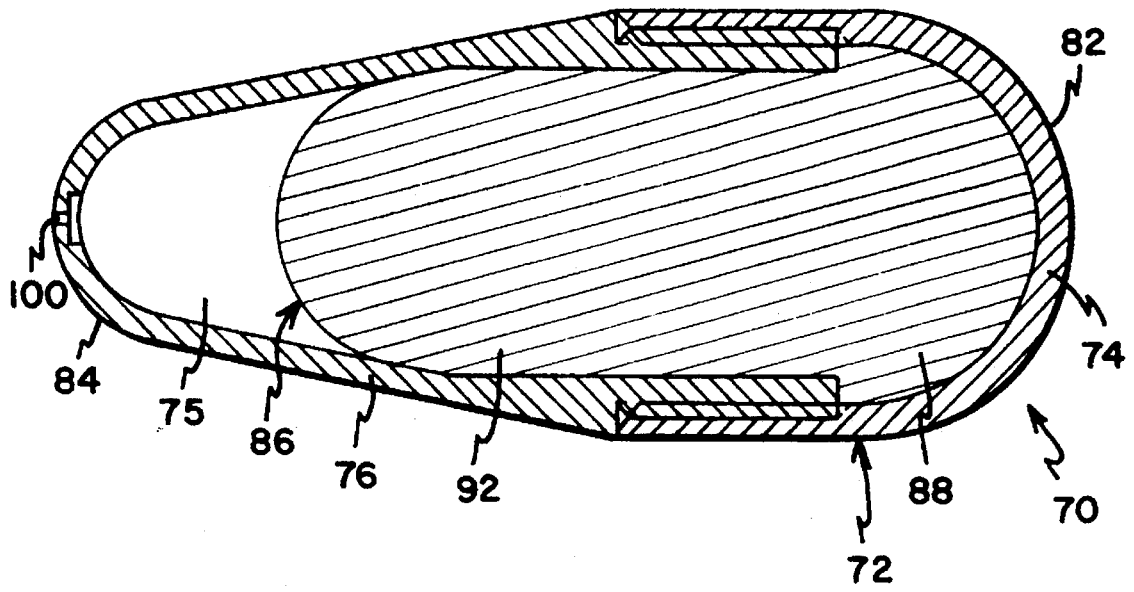
FIG. 4 is a cross-sectional view of the pelvic floor muscle testing and/or strengthening device having a shortened insert.
Figure 5:
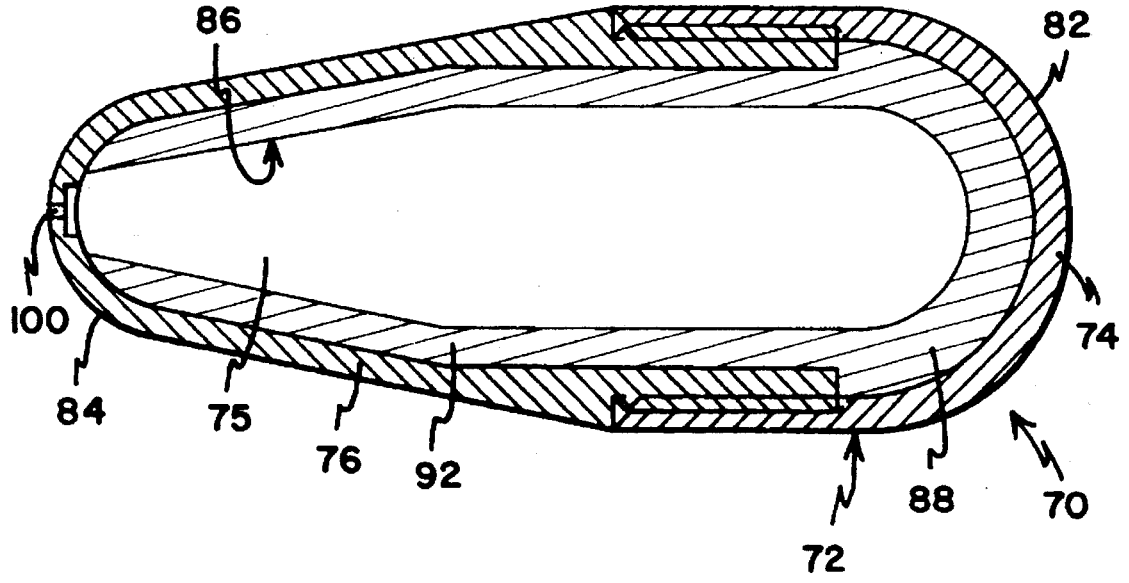
FIG. 5 is a cross-sectional view of the pelvic floor muscle testing and/or strengthening device having a hollowed insert.
Figure 6:
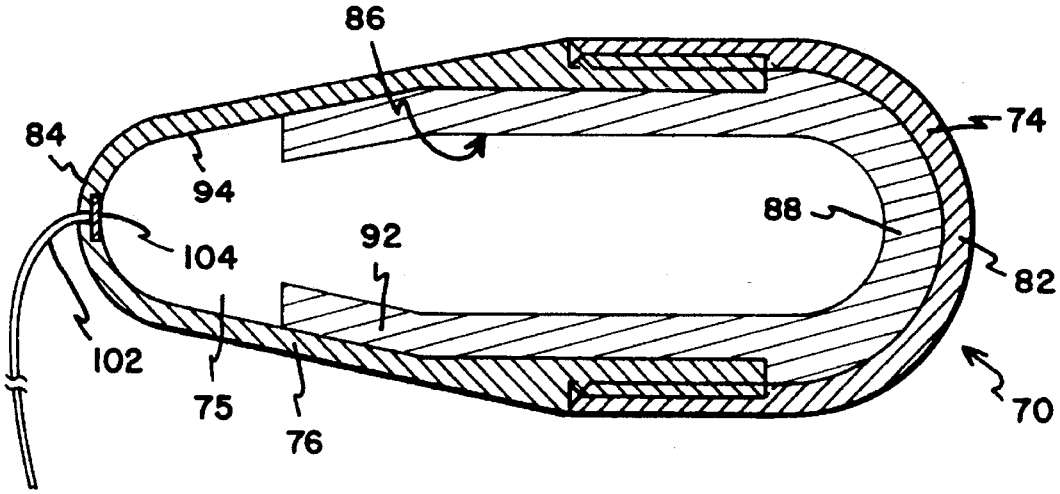
FIG. 6 is a cross-sectional view of the pelvic floor muscle testing and/or strengthening device having a hollowed and shortened insert.
Figure 7C:
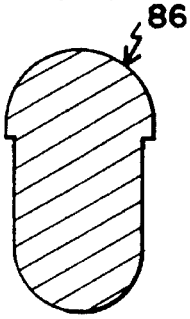
FIGS. 7C–7G illustrate a set of inserts which might be used with the hollow casings of FIGS. 7A and 7B.
Figure 7D:
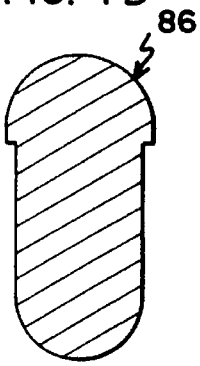
Figure 7E:
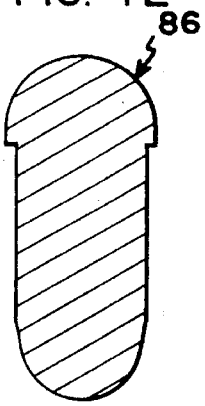
Figure 7F:
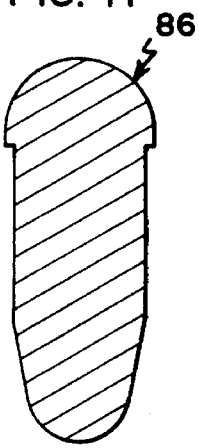
Figure 7G:
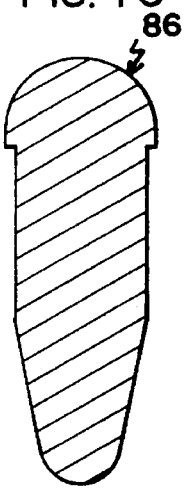
Figure 7A:
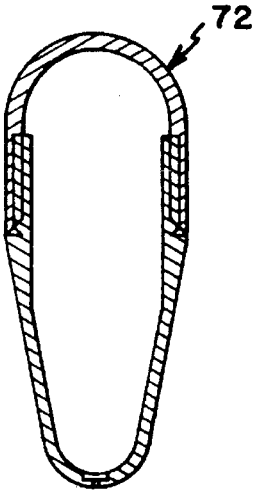
FIGS. 7A and 7B illustrate a set of hollow casings which might be included in an exercise kit in accordance with the principles of the present invention.
Figure 7B:
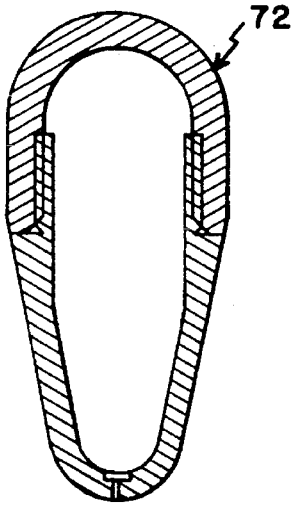
Figure 8A:
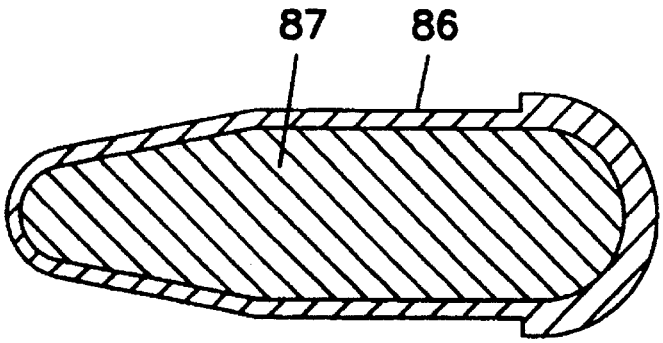
FIGS. 8A–8E illustrate alternative insert embodiments in accordance with the principles of the present invention.
Figure 8B:
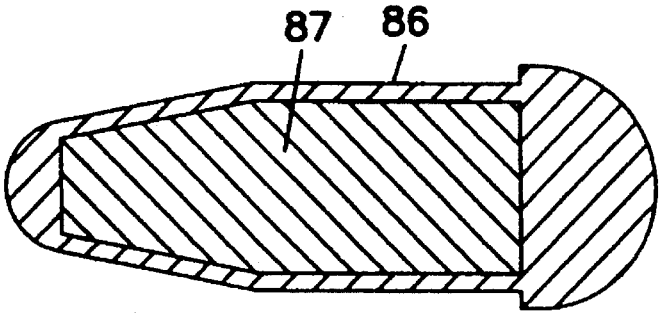
Figure 8C:
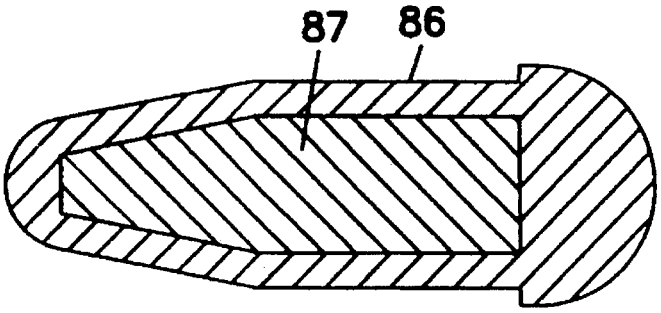
Figure 8D:
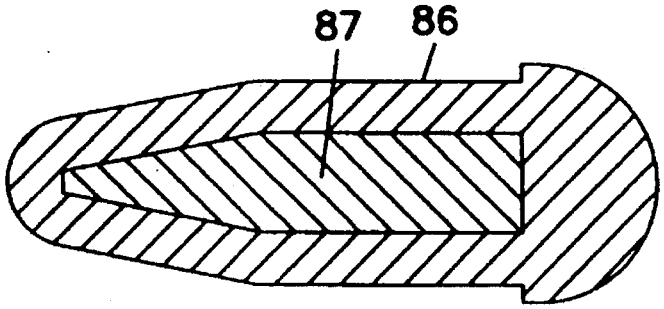
Figure 8E:
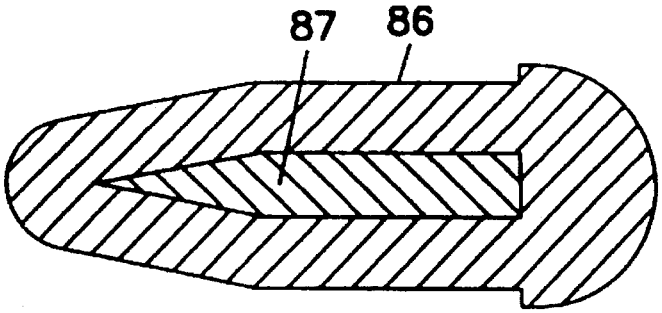

The weight of the inserts 86 is made different by changing the size and/or configuration of the inserts and/or making the inserts from materials of different densities. In the preferred embodiment, the configuration of the inserts is changed by varying the configuration of the body portion 92 and/or the head portion 88. This can best be illustrated by looking at FIGS. 2–6. The body portion 92 can be narrowed to achieve a lesser weight as shown in FIG. 3. The body portion 92 can be shortened to achieve a lesser weight as shown in FIG. 4. The body portion 92 and/or the head portion 88 can be hollowed to achieve a lesser weight as shown in FIG. 5. The body portion 92 and the head portion 88 might be both hollowed and the body portion 92 shortened as shown in FIG. 6. It is appreciated that there are various ways in keeping with the principles of the invention of varying the configuration of the insert 86 so as to vary the weight of the insert 86.

In other embodiments the head portion of the inserts 86 might be changed to vary the configuration of the inserts 86 and thus their weight. However, in the preferred embodiment the inserts 86 maintain their symmetrical design about their longitudinal axis. In addition, the shoulder portion 96 maintains the same diameter in the preferred embodiment.

As previously noted, another method of varying the weight of the insert 86 is to use materials of different densities. In the preferred embodiment, the material of the insert 86 would include aluminum, brass, bronze, stainless steel, molybdenum, manganese, titanium, lead, zinc or other alloys. The inserts 86 might be made by any suitable method. For example, they might be machined or cast. They might also be swaged or made from an alternative method such as compressed powdered metal. The inserts 86 preferably are coated with an acrylic material so that the inserts can be easily cleaned and to prevent the insert material, such as lead, from rubbing off. The weight of the inserts 86 might range from 5 to 100 grams.

Illustrated in FIGS. 7A–7G is a collection of the inserts 86 of different weight and the casings 72 of different external size in accordance with the principles of the present invention. The inserts 86 and the casings 72 might be packaged together as a kit providing an exercise device which can be individualized according to the user's needs. The inserts 86 and casings 72 might be suitably marked with indicia so as to allow the user to identify their relative weights and/or sizes. For example the inserts 86, they might be color coded and/or bear indicia indicating their weight. In the embodiment shown, the five inserts might have the following weights 15, 27.5, 40, 52.5, 65 grams. In one embodiment, the casings 72 have a length of approximately five (5) cm and a diameter of two (2) cm tapering down to about one (1) cm on the small end. The casings 72 are preferably free of cracks, burrs, gouges, embedded foreign material, smudges or contaminants. In one embodiment, the casings 72 weigh five (5) grams. It will be appreciated that varying numbers, sizes and/or configurations of the casings 72 and the inserts 86 might be utilized in keeping with the principles of the invention.

Figure 9A:
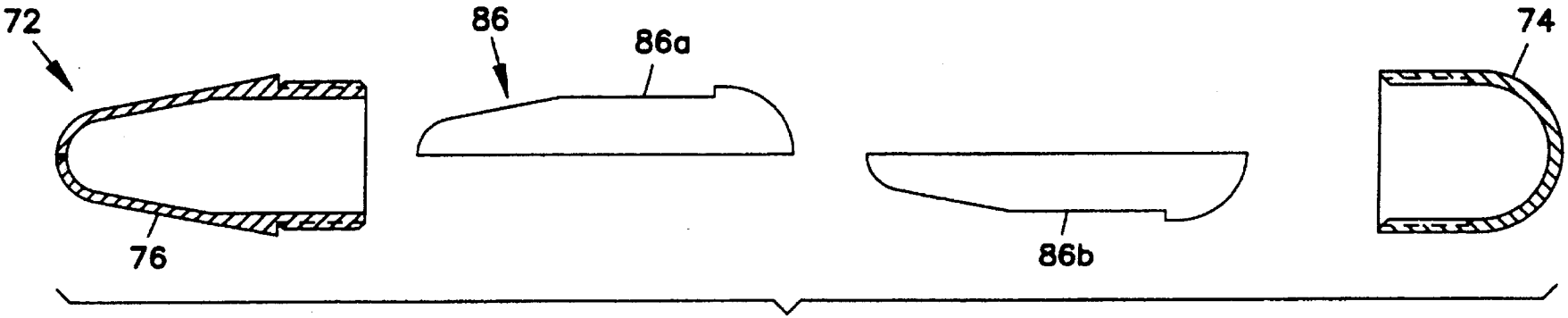
FIGS. 9A,9B illustrate yet another embodiment of the inserts in accordance with the principles of the present invention.
Figure 9B:
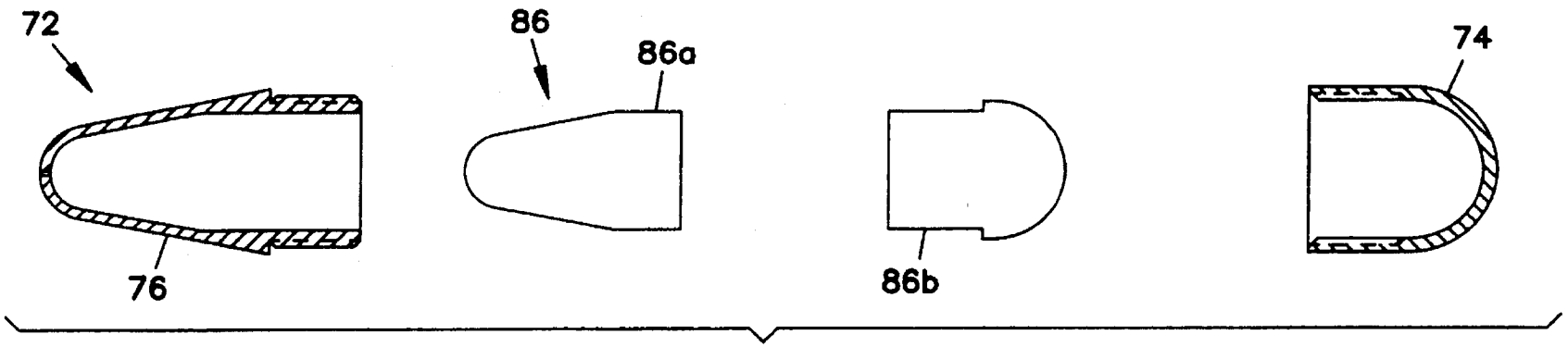
Figure 10A:
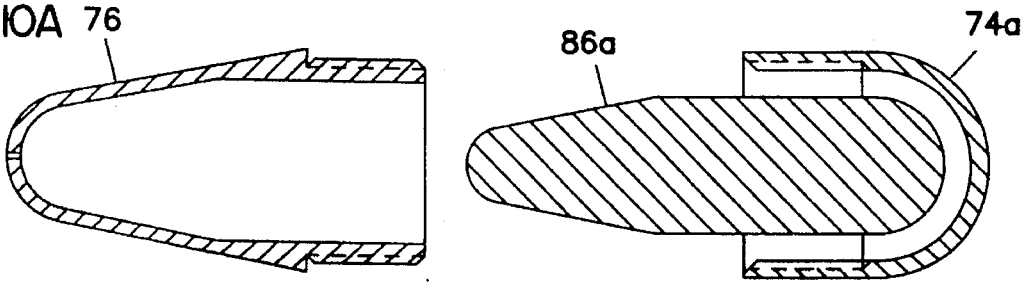
FIGS. 10A–10E illustrate exploded views of alternative embodiments of the present invention in which the inserts are integrally molded as a part of the top pieces of the casings.
Figure 10B:
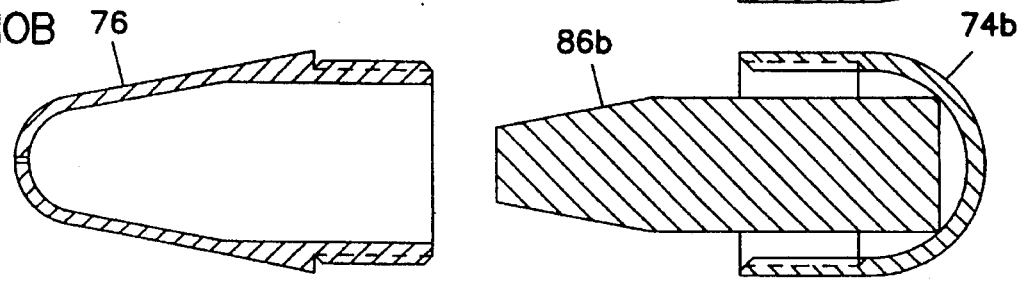
Figure 10C:
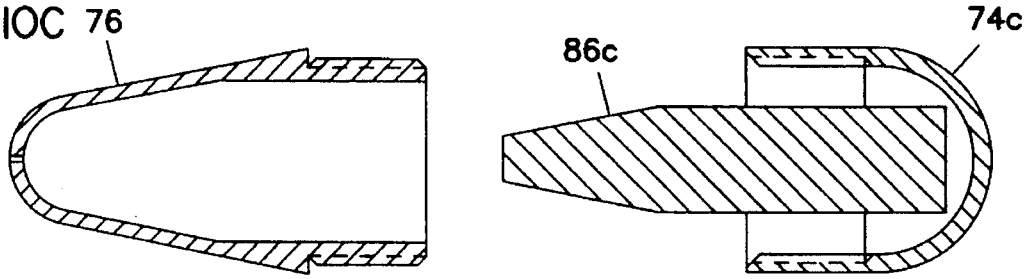
Figure 10D:
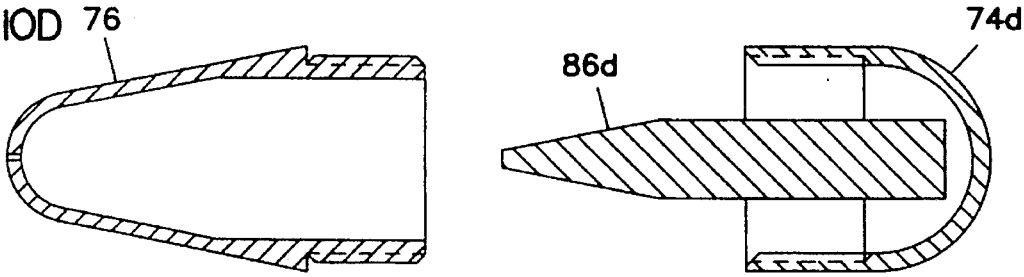
Figure 10E:
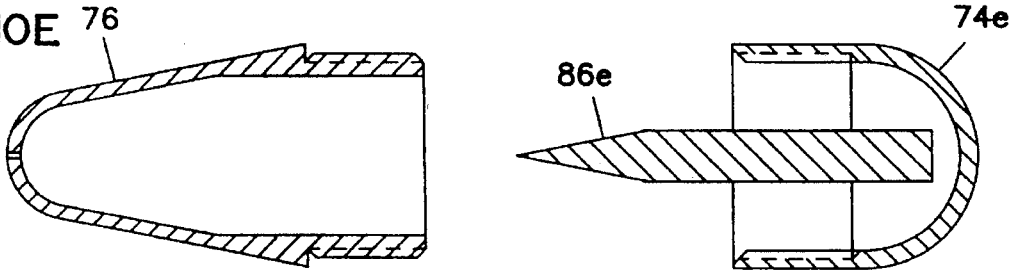

FIGS. 8A–8E illustrate alternative embodiments of the invention, wherein the inserts 86 are molded about a sub-insert 87 of varying size and/or configuration. This provides for a set of inserts having varying weights. In the embodiment shown, the inserts 86 all have the same external configuration. The inserts 86 might be molded of polystyrene and include suitable indicia or other markings reflecting their weight. For example, a suitable identification might be molded right into the polystyrene. The sub-inserts 87 might be made of metal or any other suitable material. The sub-inserts 87 might all be made of the same material or different material so as to provide the appropriate weight differential between inserts 86. The inserts 86 would preferably be insertable in a casing 72 as discussed previously Shown in FIGS. 9A,B is yet another embodiment of the present invention. In this embodiment, the inserts 86 are composed of multiple parts, preferably two parts 86*a* and 86*b*. In FIG. 9A, the parts 86*a,b* are separated along an axis extending longitudinally of the insert 86 and in FIG. 9B, the parts 86*a,b* are separated along an axis extending transversely of the insert 86. By varying the sizes and/or configurations and/or densities of the parts, the total weight of the inserts 86 can be changed. Thus a kit comprising a collection of the parts 86*a,b* can be utilized to create inserts of varying weight simply by interchanging one or more of the parts 86*a,b*. As discussed above, the inserts 86 are preferably insertable in a casing 72.

FIGS. 10A–10E illustrate alternative embodiments of the present invention. In this embodiment inserts 86*a–e* are integrally molded with the casing top piece 74*a–e*. The inserts 86*a–e* each have a different weight so as to provide the insert device 70 with a different weight simply by attaching one of the top pieces 74*a–e* to the bottom piece 76. The top pieces 74*a–e* might be suitably marked with appropriate indicia to indicate their absolute or relative weight. For example, in the embodiment shown, the inserts 86*a–e* each have a different configuration at their distal ends. The lightest of the inserts 86*a–e* has a more pointed distal end. It will be appreciated that the different top pieces 74*a–e* with their inserts 86*a–e* might be indentified in any number of ways. Also, although in the embodiment shown it is intended that the top pieces 74*a–e* are theadedly attachable to the bottom piece 76, it will be appreciated that the top and bottom pieces might be removably attachable to one another in a variety of ways, including but not limited to a bayonet type attachment, a snap type attachment, etc.

The present invention also provides an exercise device with an apparatus for removal of the exercise device from the body cavity. In the preferred embodiment shown, an opening 100 is disposed in the cone shaped end 84. A cord 102 is knotted or has a fastener 104 at one end so as to be retained in the cone shaped end 84. The cord 102 extends through the opening 100 to the outside of the casing 72. Thus, the user is able to pull on the cord 102 to remove the device 70 out of the body cavity. In the preferred embodiment, the cord 102 is able to withstand 2.25 lbs. of separating force without breaking. The cord 102 might be made of various materials such as nylon monofilament thread or other suitable soft pliable threading. In the preferred embodiment, the cord 102 has a diameter of 0.020 inches. It will be appreciated that other methods and or structures might be provided to facilitate removal of the body cavity.

In use, a user first chooses one of the external casings 72 of suitable size. The external casing 72 can be used alone without any inserts if so desired. To increase the weight of the device an insert 86 is added into the hollow inner chamber 75. If the weight of the insert 86 is not great enough or is too much, then the insert 86 is replaced by an another insert 86 having a greater weight or lesser weight as desired. In the preferred embodiment this is done by simply unthreading the top and bottom pieces of the casing 72, removing an insert and replacing it with another one. The top and bottom pieces of the casing 72 are then threaded back together. After each use, the user should wash the casing 72 with soap and water, rinse, dry and place in a suitable storage compartment. It will be appreciated that it may not be necessary to wash the inserts 86 after each use as they do not come in contact with the body.

When used as an exercise device, the user might exercise 10 to 20 minutes once or twice a day for a couple of weeks until the muscles are sufficiently strengthened. After that the user might not do any further exercising or might exercise but a few times a week. When a device of the proper weight is placed in the vagina, it has a tendency to slip out. In response to this sensation, the pelvic muscles contract around the device to retain the device in the body cavity. The user might keep a written record of their exercise progress which provides additional feedback to the user as the user can readily ascertain their progress over a period of time and see their improvement.

When used as a test device, the user would keep increasing the weight of the device until it could no longer be retained in the vagina. This provides an incremental measurement of the relative strength or condition of the pelvic muscles.

The device 70 provides the physician and patient greater flexibility in developing a pelvic muscle training program, specifically designed to meet the patient's individual needs. The different weight casings 86 and the different sized casings 72 allow a physician and/or user to custom fit the user with a device of the appropriate size and weight for exercising and/or testing of the pelvic muscles.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, materials and arrangement of parts within the principles of the invention to the full extent indicated by the broad generally meaning of the terms in which the appended claims are expressed.

What is claimed is:

1. An apparatus for testing and/or strengthening pelvic muscles, comprising:

a hollow casing defining a cavity, the casing including a top piece that is removably attached to a bottom piece, the bottom piece including an end that fits within the top piece when the top and bottom pieces of the casing are attached together; and a plurality of inserts of differing weight positionable in the cavity defined by the casing, at least one of the inserts including a head portion, a body portion and a shoulder portion, the shoulder portion being positioned between the head and body portions, wherein when the one insert is placed in the cavity of the casing, the shoulder of the insert cooperates with the end of the bottom piece of the casing to securely retain the head portion of the insert within the top piece of the casing and the base portion of the insert within the bottom piece of the casing.

2. An apparatus in accordance with claim 1, wherein the inserts are made of the same material but have different configurations so as to have different weight.

3. An apparatus in accordance with claim 1, wherein the inserts have the same configuration but have different densities so as to have different weight.

4. An apparatus in accordance with claim 1, wherein the inserts have at least one outer dimension which is the same for all the inserts.

5. An apparatus in accordance with claim 1, including a plurality of hollow casings of differing sizes.

6. An apparatus in accordance with claim 5, wherein the inner cavities of the hollow casings are of the same size.

7. An apparatus in accordance with claim 5, wherein the inner cavities of the hollow casing have at least one inner dimension which is the same for all the casings.

8. An apparatus in accordance with claim 1, wherein the hollow casing includes a top casing portion and a bottom casing portion which are threadedly attachable to each other.

9. An apparatus in accordance with claim 1, wherein the inserts are concentrically disposed in the casing.

10. An apparatus in accordance with claim 1, wherein the inserts are molded about sub-inserts.

11. An apparatus in accordance with claim 1, wherein the inserts are separated into distinct and separate parts.

12. An apparatus in accordance with claim 1, wherein the casing includes first and second portions which are removably and non-destructively attachable to one another to form the casing, one of said inserts being integrally molded to one of said portions.

13. An apparatus in accordance with claim 1, wherein a plurality of the inserts have head portions, body portions and shoulder portions, the shoulder portions being located between the head portions and the body portions, the shoulder portions cooperating with the end of the bottom piece of the casing to secure the inserts within the cavity of the casing, and the body portions having different configurations such that the inserts have different weights.

14. An apparatus in accordance with claim 1, wherein at least one of the inserts includes two parts which are separated along an axis extending longitudinally through the insert.

15. An apparatus in accordance with claim 1, wherein at least one of the inserts includes two parts which are separated along an axis extending transversely through the insert.

16. An apparatus in accordance with claim 1, wherein the shoulder of the one insert circumferentially surrounds the insert.

17. An apparatus in accordance with claim 1, wherein the head portion forms a rounded first end of the insert and the base portion forms a generally cone-shaped second end of the insert.

* * * * *